United States Patent [19]

Vollmer

[11] 4,264,013

[45] Apr. 28, 1981

[54] JEWELRY HOLDER

[76] Inventor: Mary C. Vollmer, 609 Centre St., Haddonfield, N.J. 08033

[21] Appl. No.: 29,336

[22] Filed: Apr. 12, 1979

[51] Int. Cl.[3] ..... A47F 7/00

[52] U.S. Cl. ..... 211/13; 248/304; 248/309 A; 248/224.3

[58] Field of Search ..... 211/13, 57.1, 59.1; 248/220.2, 220.3, 223.4, 224.1, 224.2, 224.3, 239, 304, 309 A, 339, 341, 450, 27.1, 231.1; 206/566

[56] References Cited

U.S. PATENT DOCUMENTS

| | | | |
|---|---|---|---|
| 260,450 | 7/1882 | Cahoone | 211/13 X |
| 732,828 | 7/1903 | Christopher | 248/450 |
| 2,131,960 | 10/1938 | Less | 211/13 X |
| 2,930,567 | 3/1960 | Lloyd-Young | 211/13 X |
| 2,964,196 | 12/1960 | Phillips | 211/13 |
| 2,988,315 | 6/1961 | Saxe | 248/304 X |
| 3,421,634 | 1/1969 | Huth | 211/13 X |
| 3,718,260 | 2/1973 | Sharp | 211/13 |
| 3,912,212 | 10/1975 | Betts | 248/220.3 |
| 4,141,453 | 2/1979 | Hanan | 211/13 X |

FOREIGN PATENT DOCUMENTS

| | | | |
|---|---|---|---|
| 550501 | 12/1957 | Canada | 211/59.1 |

*Primary Examiner*—William H. Schultz
*Attorney, Agent, or Firm*—Thomas A. Lennox

[57] ABSTRACT

A jewelry holder attached to the wall or door in a bedroom or dressing room is provided with a horizontal front panel having apertures in which detachable hooks are frictionally wedged to hold chains, necklaces and the like. Bracelet, ring and earring holders are provided along the top of the front panel.

9 Claims, 5 Drawing Figures

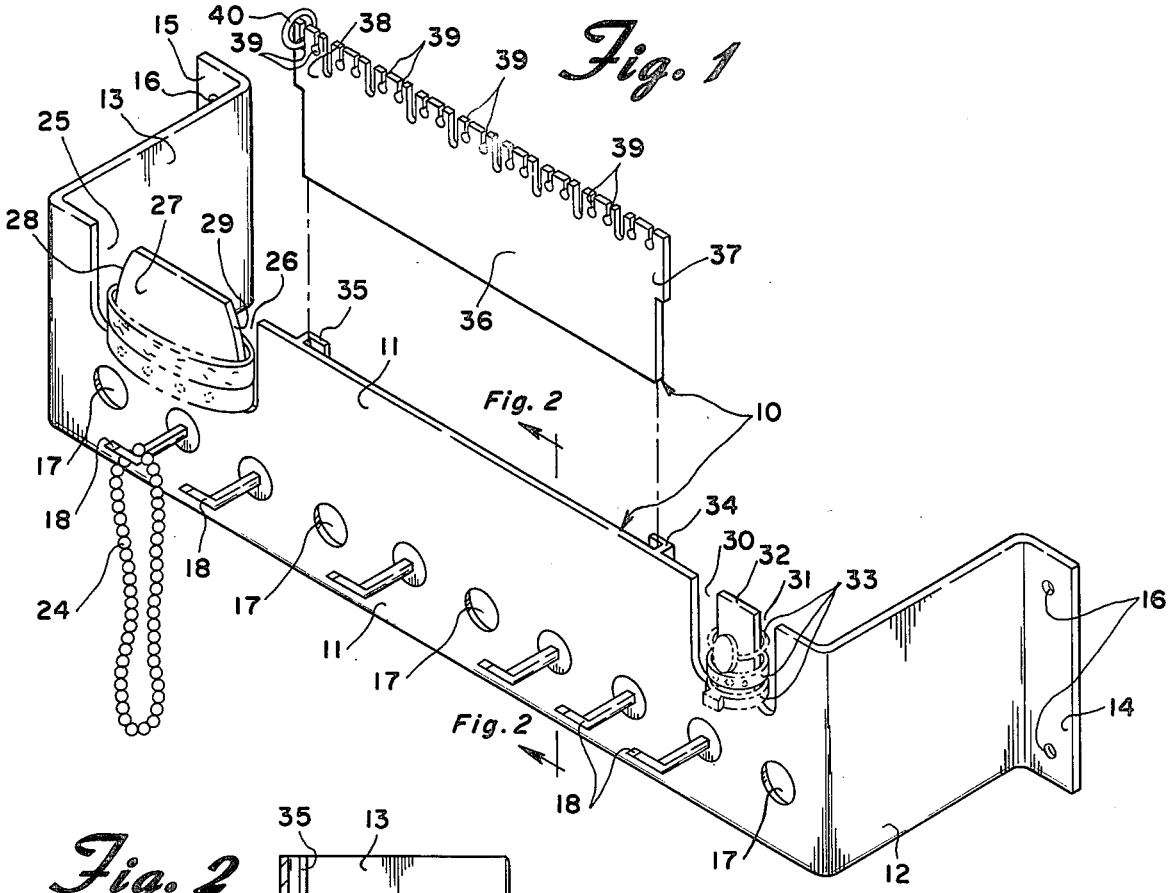
Fig. 1
Fig. 2
Fig. 2
15
40
38
39
39
39
39
16
13
25
28
27
29
26
35
36
37
11
10
17
18
34
30
32
31
33
24
18
17
11
17
16
14
18
17
12
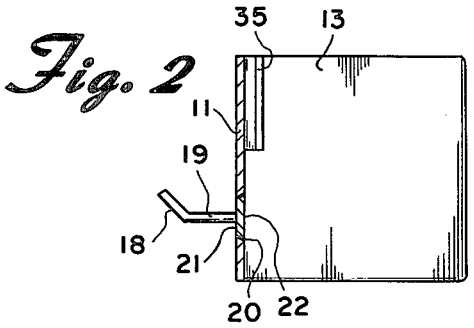
Fig. 2
35
13
11
19
18
21
20
22
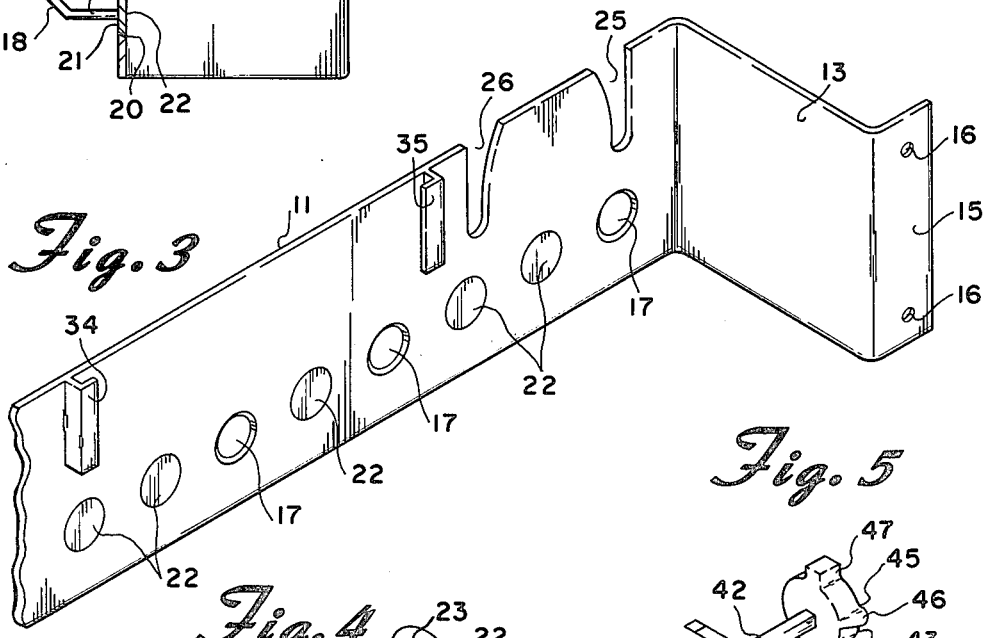
Fig. 3
25
26
13
35
16
11
15
17
16
34
22
17
22
17
22
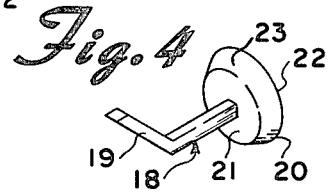
Fig. 4
23
22
19
18
21
20
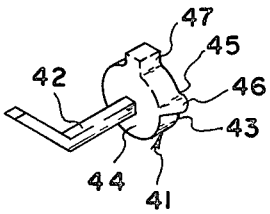
Fig. 5
47
45
42
46
43
44
41

JEWELRY HOLDER

BACKGROUND OF THE INVENTION

This invention relates to the general field of jewelry holders and jewelry caddies. A variety of jewelry holders have been described in prior art including the finger ring exhibitor by M. Adams in U.S. Pat. No. 608,946. Later versions include the jewelry cabinet described in U.S. Pat. No. 930,702 to Pichowicz and a jewelry caddy in U.S. Pat. No. 3,997,050 to C. W. Patterson.

None of these prior art devices nor any of the other devices on the market satisfy the need of the person, male or female, with an average collection of costume jewelry. Many persons have jewelry chosen to fit and go with a particular outfit. Typically, this jewelry does not contain precious gems, but does vary in cost from inexpensive costume jewelry to the more unique pieces having artwork. The jewelry varies considerably as to the weight, thickness and size of chains with the size, shape and weight of pendants varying considerably. Many of these pendants are constructed of glass, ceramic or other breakable substances. It has been found that no jewelry box or jewelry caddy with any limit on the size will allow the typical jewelry collection to be stored and separated. Changing styles in costume jewelry will shortly make any jewelry box outmoded. The above described jewelry holders cannot adjust to different quantities and kinds of jewelry and further use up a significant amount of the top of the dresser space. Further, none of the prior art devices allow for interchange of the size and number of the posts and hooks to hold the jewelry. The above described prior art does not satisfy the objects of this invention provided herebelow.

It is an object of this invention to provide a jewelry holder which accommodates and holds chains, necklaces, finger rings and bracelets in varying size and number.

It is a further object of this invention to provide a variable accommodations for chains and the like of varying sizes and weight.

It is a further object of this invention to provide capability of substituting various size and shape hooks and posts to accommodate different kinds and styles of jewelry.

It is an additional object of this invention to avoid the use of any space on the top of dresser or cabinet in the bedroom.

It is a further object to provide a jewelry holder that does not detract but rather adds to the decor of the room.

It is an additional object of this invention to provide a capability that each individual chain or like item may be stored individually for ready removal without interfering with storage on adjacent hooks or posts.

It is a particular object of this invention to provide the capability of adjusting the space between the adjacent hooks or posts holding the chain or like item.

It is a further object of this invention to provide a jewelry holder which not only provides for hanging of chains or like jewelry, but also provides for storage for solid ring bracelets, finger rings and earrings, also separated and held in separate accommodations.

My invention, as described hereinbelow, satisfies these and other objects which will be apparent to the reader of this disclosure.

SUMMARY OF THE INVENTION

My invention is particularly directed to the storage of chains, necklaces and chain bracelets which cannot be stored easily in the prior devices. Throughout the specification and the claims, reference may be made to "chain" and whenever this term is used, it is intended to include all types of bracelets, necklaces, anklets, bracelets with or without pendants, stones, medallions, or other decorative pieces hanging from or as part of a chain. The term "chain" is intended to include all items of jewelry which comprise one or more links in forming the item of jewelry and are of such a shape that they will hang on a post or hook of any shape whatsoever.

My jewelry holder preferably includes two rear cantilever members which are provided with means to mount each of the members to a vertical face, typically a bedroom or dressing room wall, although it may be mounted on the outside or inside of a closet door or even on the inside of the dressing room or bedroom door. A preferred mounting means is a flange through which holes are drilled to allow decorative screws to secure the members to the wall at a common height. The wall attachment system is structurally attached to a front panel. This panel has a face essentially parallel to that of the vertical wall, by which it is intended to include an angle of ten to fiteen degrees from the vertical without detracting from its effectiveness. It is preferred that the panel have a length substantially longer than that of the length of the distance from the panel to the vertical wall. The front panel has a plurality of apertures through the panel spaced along the length of the front panel. The preferred distances between the apertures is the minimum distance that would allow chains to be hung on hooks without interference with adjacent hooks. In this preferred embodiment, as the thickness of the chain is increased, or appendages from the chain get in the way of adjacent hooks, apertures may be skipped thus providing a neater and more effective use of the jewelry holder.

Chain holding devices are provided constructed with a base member, it being capable of demountably engaging in the apertures from the rear of the front panel. These base members have at least one dimension being of such size as to prevent the base member from passing through the aperture, the dimension causing the base member to wedge into the aperture securely. At least one hook or post type structure is structurally attached to each of the base members, the shape and size of the hook or post being chosen to hold any chosen size, thickness or shape of chain.

BRIEF DESCRIPTION OF DRAWINGS

FIG. 1 is a perspective view of the jewelry holder of this invention with the detachable earring holder portion held separately.

FIG. 2 is a cross-sectional view along lines 2—2 of FIG. 1.

FIG. 3 is an expanded partial perspective view of the rear of the jewelry holder of FIG. 1.

FIG. 4 is an expanded perspective view of a hook and base for insertion in the jewelry holder of FIG. 1.

FIG. 5 is an expanded perspective view of a hook and base for insertion in a jewelry holder of this invention.

DESCRIPTION OF PREFERRED EMBODIMENTS

A key element in this invention is the chain holding means. A preferred embodiment of the base member of the chain holding device is described hereinbelow. It is preferred that the base be further formed such that the front face of the base member be smaller than the rear face of the member, such that when the base member is pulled out through the aperture, the base member frictionally wedges into the aperture. It is further preferred that the shape of the base member be chosen such that it can be wedged into the aperture in only one orientation that being to place the hook in an upright position.

As will be described below, it is further preferred that the jewelry holder include means for holding other types of jewelry including a ring bracelet support, a finger ring support and an earring support and further that all of these supports be formed along the upper edge of the front panel with the chain holding system being located along the lower portion of the front panel.

The ring bracelet and the ring holding device are preferably each constructed by cutting a pair of deep notches downwardly from the top of the front panel to form a tongue shape extending vertically between the two notches. This tongue shape which may be described as a plateau is varied as to size by spacing the notches. Thus, in order to store bracelets for the wrist, the notches are spaced further apart than they are for the finger ring support.

It is further preferred for the wrist ring bracelet holder that the sides of the notches adjacent to each other, that being the sides of the plateau formed between the notches, be sloping away from the center of the plateau flaring toward the bottom. This allows bracelets of slightly varying sizes to fit over the top of the plateau and rest on the sloped sides of the plateau.

An additional preferred embodiment of this invention includes an earring holder which includes a sheet detachably fixed to the front panel, preferably to the back of the front panel but, in any case, having the top portion of the sheet extending above the top of the front panel. The top of the sheet has a plurality of vertical slots cut downwardly into the top edge of the sheet of sufficient size, shape, and depth to allow earrings to be slipped into the slot and held there until ready for next use where they may be easily slipped out of the same slots.

The jewelry caddy described in FIG. 1 is formed of a colorless, transparent sheet of cast poly methyl methacrylate such as sold under the trademark PLEXIGLAS. The sheet is 26 inches long, 4 inches wide and a nominal ¼ inch thick. Jewelry holder 10 is thermo-formed in the shape applying heat to the selected portions of the sheet and making the appropriate bends, holding the jewelry holder in position while the plastic cools. Front panel 11 is about 16 inches long while each side panel 12 and 13 is each about 4 inches long leaving flanges 14 and 15 to be about 1 inch long. The entire structure jewelry holder 10 is fixed to a vertical wall (not shown) by inserting screws in holes 16 and screwing the entire structure to the wall.

Spaced across the lower portion of panel 11 are ½ inch diameter holes 17, most of which are plugged with hook elements 18 which are more clearly shown in FIG. 4. Metal hook 19 is imbedded in acrylic molding base member 20 with front face 21 being of slightly less than ½ inch diameter and rear face 22 being slightly greater than ½ inch diameter such that beveled edge 23 wedges in hole 17. Hook assemblies 18 may be inserted in every hole 17, or, if thick or bulky chains are used, certain holes may be skipped as shown in FIG. 1. Chain 24 is shown hanging to demonstrate the use of this invention, but clearly a very large capacity storage is possible.

Deep notches 25 and 26 are cut downwardly from the top edge of front panel 11 as shown in both FIG. 1 and FIG. 3. Plateau 27 is left between these notches over which solid bracelet rings may be stacked and stored. Sloped edges 28 and 29 allow the rings to breast at various levels without scratching. On the opposite end of front panel 11 are cut notches 30 and 31 to form plateau 32 over which rings 33 may be conveniently stored. Toward the center of panel 11 are provided two L-shaped flanges 34 and 35 more clearly shown in FIG. 3, with a side view in FIG. 2. Earring holder sheet 36, a ⅛ inch thick sheet of clear plexiglass with shoulders 37 and 38 which fit over L-slots 34 and 35 to hold wheet 36 at a level exposing pairs of slots 39 of such width and depth to allow earring 40 and other pairs of earrings to be stored and easily removed from the holder. The rear of jewelry holder 10 is shown in FIG. 3 showing how hook assemblies 18 are wedged in holes 17 such that only rear face 22 shows from the rear.

In FIG. 5, a preferred structure of hook assembly 41 is shown with metal hook 42 imbedded in base member 43 in which front face 44 is essentially the same size as the aperture cut for this assembly while rear face 45 has raised portion 46 on two sides which is larger than the aperture. This raised portion 46 slopes down toward the front face 44 such that as hook assembly 41 is crasped by metal hook 42 and pulled into the aperture, it will wedge in place. Key-shape 47 orients hook assembly 41 such that hook 42 is always in an upright position.

While my invention is described with reference to the specific embodiments disclosed herein, it is not confined to the details set forth and the patent is intended to include modifications and changes which may come within and extend from the following claims.

I claim:

1. A jewelry holder comprising:

(a) a front panel, (b) a structure means structurally connecting the front panel to a (c) mounting means for mountably attaching the structural means to a vertical face, wherein the front panel has a plurality of apertures through the panel spaced along the length of the front panel and (d) a chain holding means comprising (i) a plurality of base members, each capable of being demountably engaged in the apertures from the rear of the front panel, and (ii) at least one hook means structurally attached to each of the base members, the size and the shape of each hook means being chosen to hold a particular size of chain to hang from the jewelry holder.

wherein at least one of the dimensions of each base member is of such size to prevent the base member from passing completely through the aperture, the front panel of the base member is equal to or smaller than the aperture and the rear face of the base member is slightly larger than the aperture to cause the base member to frictionally wedge into the aperture.

2. The jewelry holder of claim 1 wherein the shape of the faces of the base member and the apertures are chosen to orient the hook means in an upright position.

3. The jewelry holder of claim 1 wherein a solid bracelet support holding means, a ring holding means and an earring holding means are all provided along the upper edge of the front panel with the chain holding means being located along the front panel below these three holding means.

4. The jewelry holder of claim 1 wherein a solid ring bracelet holding means is provided on the front panel comprising a pair of deep notches cut downwardly from the top of the front panel, the space between the notches being chosen to allow the bracelets to fit over the vertical portion of the front panel left between the two notches.

5. The jewelry holder of claim 4 wherein the sides of the notches adjacent to each other are sloped outwardly at the top of each notch from the vertical centerline, to form a center plateau shape having sloped sides flaring toward the bottom, and wherein the space between the notches is chosen to allow bracelets to fit over the top of the plateau and rest on the sloped sides of the plateau.

6. The jewelry holder of claim 1 wherein a finger ring holding means is provided on the front panel comprising a pair of deep notches cut downwardly from the top of the front panel, the space between the notches being chosen to allow rings to fit over the vertical portion of the front panel left between the two notches.

7. The jewelry holder of claim 1 wherein an earring holding means is provided on the front panel comprising a sheet detachably fixed to the front panel having the top portion of the sheet extending above the top of the front panel, wherein, the top of the sheet has a plurality of vertical slots cut downwardly into the top edge of the sheet of a size, shape and depth to allow earrings to be slipped in and out of the slots.

8. A jewelry holder comprising:

(a) two rear cantilever members, (b) mounting means for mountably attaching one end of each of the cantilever members to a vertical face at a common height, (c) a front panel having each end structurally attached to the exposed ends of the cantilever members, the front panel having a length substantially longer than that of the length of the cantilever members and having a face essentially parallel to that of the vertical face, wherein, the front panel has a plurality of apertures through the panel spaced along the length of the front panel, and (d) a chain holding means comprising (i) a plurality of base members, each capable of being demountably engaged in the apertures from the rear of the front panel, and (ii) at least one hook means structurally attached to each of the base members, the size and the shape of each hook means chosen to hold a particular size of chains to hang from the jewelry holder, wherein at least one of the dimensions of each base member is of such size to prevent the base member from passing completely through the aperture, the front face of the base member is equal to or smaller than the aperture and the rear face of the base member is slightly larger than the aperture to cause the base member to frictionally wedge into the aperture.

9. A jewelry holder comprising:

(a) a front panel, (b) a structure means structurally connecting the front panel to a (c) mounting means for mountably attaching the structure means to a vertical face, wherein the front panel has a plurality of apertures through the panel spaced along the length of the front panel and (d) a chain holding means comprising (i) a plurality of base members, each capable of being demountably engaged in the apertures from the rear of the front panel, and (ii) at least one hook means structurally attached to each of the base members, the size and shape of each hook means being chosen to hold a particular size of chain to hang from the jewelry holder, wherein at least one of the dimensions of each base member is of such size to prevent the base member from passing completely through the aperture, the front face of the base member is equal to or smaller than the aperture and the rear face of the base member is slightly larger than the aperture to cause the base member to frictionally wedge into the aperture (e) a solid bracelet holding means on the front panel comprising a pair of deep notches cut downwardly from the top of the front panel, the space between the notches being chosen to allow the bracelets to fit over the vertical portion of the front panel left between the two notches, (f) a finger ring holding means on the front panel comprising a pair of deep notches cut downwardly from the top of the front panel, the space between the notches being chosen to allow the rings to fit over the vertical portion of the front panel left between the two notches, and (g) an earring holding means on the front panel comprising a sheet detachably fixed to the front panel having the top portion of the sheet extending above the top of the front panel, wherein the top of the sheet has a plurality of vertical slots cut downwardly into the top edge of the sheet of a size, shape and depth to allow the earrings to be slipped in and out of the slots.

* * * * *